United States Patent [19]

Pane et al.

[11] 4,077,205

[45] Mar. 7, 1978

[54] LOUVER CONSTRUCTION FOR LINER OF GAS TURBINE ENGINE COMBUSTOR

[75] Inventors: Francis C. Pane, South Windsor; Domingo Sepulveda, Cromwell, both of Conn.

[73] Assignee: United Technologies Corporation, Hartford, Conn.

[21] Appl. No.: 721,145

[22] Filed: Sep. 7, 1976

Related U.S. Application Data

[62] Division of Ser. No. 638,012, Dec. 5, 1975.

[51] Int. Cl.[2] ..... F02C 7/18; F02C 7/20

[52] U.S. Cl. ..... 60/39.32; 60/39.65; 60/39.66

[58] Field of Search ..... 60/39.65, 39.66, 39.32

[56] References Cited

U.S. PATENT DOCUMENTS

| | | | |
|---|---|---|---|
| 2,670,601 | 3/1954 | Williams et al. | 60/39.65 |
| 2,692,478 | 10/1954 | Hill | 60/39.32 |
| 2,840,989 | 7/1958 | Macaulay | 60/39.65 |
| 2,884,759 | 5/1959 | Sevcik | 60/39.65 |
| 3,307,354 | 3/1967 | Macaulay et al. | 60/39.66 |
| 3,408,812 | 11/1968 | Stenger | 60/39.66 |
| 3,844,116 | 10/1974 | Matto | 60/39.32 |
| 3,978,662 | 9/1976 | DuBell et al. | 60/39.36 |

*Primary Examiner*—Robert E. Garrett

*Attorney, Agent, or Firm*—Norman Friedland

[57] ABSTRACT

This invention relates to an improved combustor liner for a gas turbine power plant which liner is constructed from a plurality of louvers that include a lip and cooling means for defining a cooling film of air flow adjacent the liner. Means are provided for preventing lip closure which in turn is detrimental to film cooling.

3 Claims, 7 Drawing Figures

LOUVER CONSTRUCTION FOR LINER OF GAS TURBINE ENGINE COMBUSTOR

This is a division of application Ser. No. 638,012, filed Dec. 5, 1975.

BACKGROUND OF THE INVENTION

This invention relates to gas turbine engines and particularly to louver constructed combustor liners.

This invention constitutes an improvement over the liner disclosed and claimed in U.S. Pat. No. 3,643,430 granted to John Emory, Jr. and Joseph Faitani on Feb. 22, 1972 and assigned to the same assignee. As shown in this patent the outer liner is formed from a plurality of louvers suitably attached to form a combustion chamber and an annular cooling chamber. As is well known in the art cooling holes are formed in the upstream vertical wall of each louver so that cooling air is introduced into the combustion zone and the construction of the liner includes a lip portion that directs the air into a film of cooling air. Owing to the extremely high temperature these lips have a tendency of buckling and the art has shown different means intended to prevent the lip from collapsing. Obviously, collapsing of the wall would destroy or impair the film cooling of the downstream louver wall.

One such means, for example, for preventing the lip from total collapsing was to locate a plurality of "dimples" formed in the hot wall of the liner (that wall closest to the combustion chamber) circumferentially spaced about the wall. The "dimple" defining a spacer projected toward the adjacent wall of the downstream louver short of touching. When the lip buckled owing to the high temperature levels, the spacer bore against the adjacent wall and while it blocked the overhead flow, cooling flow between spacers migrated downstream. The "dimple" since it was stamped into the sheet metal louver contained high stress points and upon extended cyclic operation cracking propagated upstream thereof.

Since the "dimple" acts as a blockage to the cooling flow immediately downstream thereof, and as a chuting passage for hot gases generated by the combustor, severe louver burning was evidenced.

We have found that we can obviate the problems noted above by locating the "dimple" spacer on the cooler wall of the liner (the wall furthest away from the combustion chamber) and locating a hole in or adjacent the "dimple" for directing cooling air to discharge downstream thereof.

In another embodiment this invention contemplates including cylindrically shaped spacers (posts) such as rods, rivets or the like, projecting either from the cool or hot wall and extending between the walls. The dimension of the posts are such that it minimizes cooling flow blockage and the resultant entrainment of hot gases. Both types of spacers, (posts or dimples) terminate short of the adjacent walls when in the unheated condition.

SUMMARY OF THE INVENTION

An object of this invention is to provide an improved combustion liner for gas turbine engine.

A still further object of this invention is to provide in a louver liner spacer means by indenting the cooler louver wall to provide a plurality of "dimples" spaced circumferentially about the louver, and locating holes to discharge cooling air downstream of the dimple.

A still further object of this invention is to provide in a louver liner as described judiciously dimensioned posts extending between overlapping louver walls which post may be mounted on either the hot or cold walls.

Other features and advantages will be apparent from the specification and claims and from the accompanying drawings which illustrate an embodiment of the invention.

DESCRIPTION OF THE PREFERRED EMBODIMENT

For a detailed description of a typical louvered lining of a gas turbine combustor reference should be made to U.S. Pat. No. 2,643,430, supra, incorporated herein by reference. The portion of the existing louver constructed liner that this invention deals with is the lip which typically has problems in buckling and has cracking problems when a "dimpled" post was incorporated on the hot wall. Such problem adversely affected the operational life of the combustor and it is contemplated by this invention that these problems will be obviated.

Figure 1:
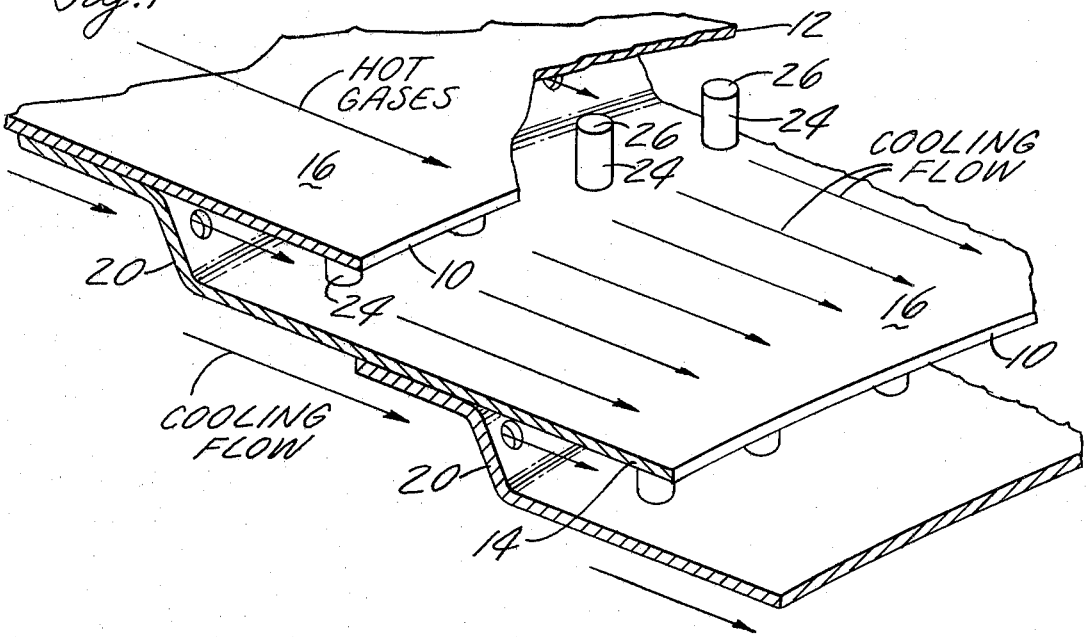
FIG. 1 is a partial view in perspective showing a portion of a louver liner illustrating this invention.
Figure 2:
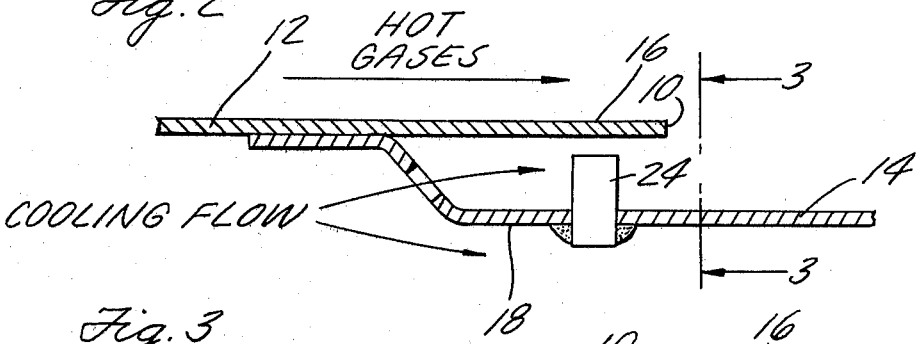
FIG. 2 is a partial sectional view of two adjacent louvers.
Figure 3:
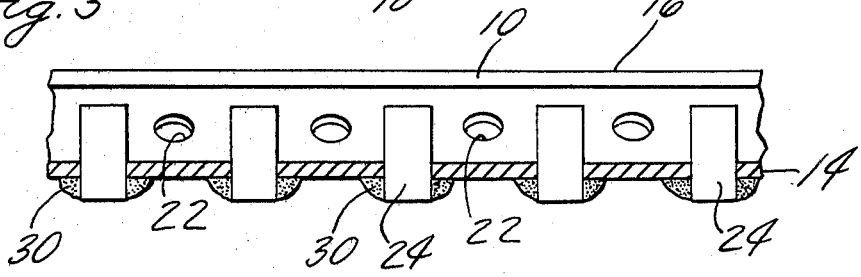
FIG. 3 is a section taken along the lines 3—3 of FIG. 2.

As can be seen by referring to FIGS. 1, 2 and 3 the lip 10 of the upper louver 12 extends downstream of the stepped portion 20 of lower louver 14. Each louver is annular shaped and upon assembly form an annular combustion chamber. The assembled liner forms an inner hot wall surface 16 (that surface that is closest to combustion) and an outer or cool wall surface 18 (that surface closest to the cooling air flow) which typically surrounds the outside of the liner.

The stepped portion 20 of each louver contains a plurality of holes 22 extending circumferentially around the liner which directs cooling air adjacent the hot surfaces 16 and forms in a well known manner a film of cooling air.

As was mentioned above the problem solved by this invention is the minimizing of cracks propagated by the heretofore spacers that were utilized to prevent the lip 10 from collapsing. In accordance with this invention a plurality of posts 24 extend from the cool wall and terminate short of the inner face of lip 10 and circumferentially span around the liner. The top face 26 of each post is flat so as to form a supporting surface for the lip when it bears thereon as a result of the high temperature levels. The diameter of the post are sufficiently small so that flow of the cooling air will flow evenly and will not separate when flowing downstream. Thus, when the flow at the top is blocked off when the lip bears against the post cooling flow will still discharge downstream of the post. It is important that the flow doesn't separate since this would adversely affect the cooling air at the point of flow separation causing excessive liner wall burning.

As can be seen in FIGS. 2 and 3 post 24 may be a rivet and the head 30 may be suitably welded into place. While other shapes of the post may be utilized, the cylindrical shape is preferred since it is easier to install and it need not be oriented with respect to the flow, since it is not sensitive to flow approach angle.

The posts could be mounted on the hot wall at the lip 10 and extend toward the louver 14 without departing from the scope of this invention.

Figure 4:
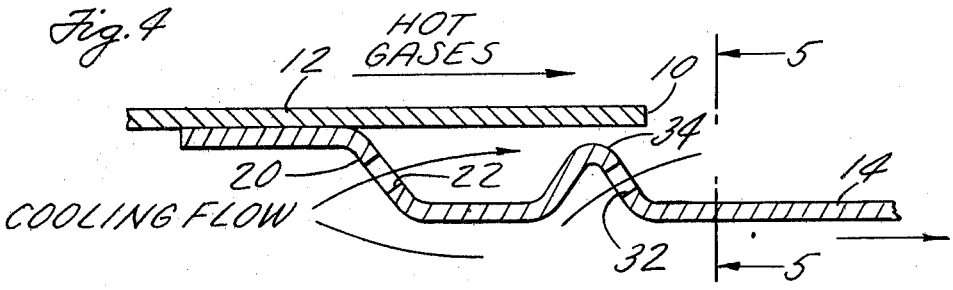
FIG. 4 is a partial sectional view of two adjacent louvers of another embodiment.
Figure 5:
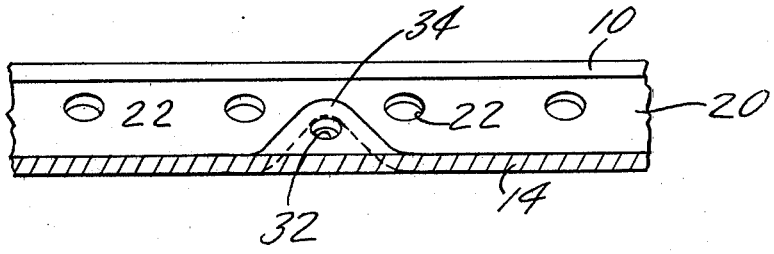
FIG. 5 is a section taken along line 5—5 of FIG. 4.

FIGS. 4 and 5 show another embodiment of this invention where like reference numerals designate like parts. In this embodiment a plurality of "dimples" 34 (only one being shown) are formed in louver 14 on the cool wall and extends toward the lip 10 and terminates short thereof. The "dimples" serve as spacers similarly to the posts 24 of FIG. 1. A cooling hole 32 is located on the downstream side with respect to flow. Hence, when the "dimple" is pinched off when the liner becomes hot, cooling flow will discharge through the hole downstream of the "dimple" preventing this area from becoming excessively hot.

Figure 6:
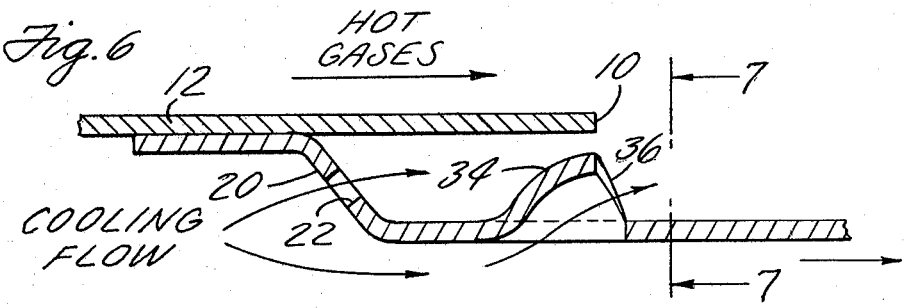
FIG. 6 is a partial sectional view of two adjacent louvers of another embodiment.
Figure 7:
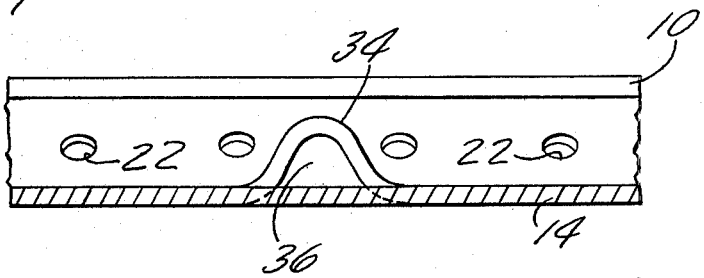
FIG. 7 is a section taken along lines 7—7 of FIG. 6.

FIGS. 6 and 7 show still another embodiment which is similar to FIG. 4 and like reference numerals designate like parts. The only difference in this embodiment is that the louver wall adjacent the downstream end of "dimple" 34 is slit prior to the formation of the dimple. The metal is pinched adjacent the slit which serves to provide the opening 36 without the necessity of drilling holes as the case would be in connection with FIG. 4.

As is apparent from the foregoing, the "dimples" in both the FIG. 4 and FIG. 6 embodiments are formed in the cool wall so that the downstream discharge holes will communicate with cooling air.

What has been shown by this invention is simplified means, characterized as easy to manufacture and relatively inexpensive, for preventing the lip from collapsing and obstructing the film cooling while at the same time eliminating the hot wall cracking tendency thereby extending the life of the liner.

It should be understood that the invention is not limited to the particular embodiments shown and described herein, but that various changes and modification may be made without departing from the spirit or scope of this novel concept as defined by the following claims.

We claim:

1. For a louver constructed liner for a gas turbine power plant combustor that has a hot wall portion and a cooler wall portion, the hot wall portion subjected to gases of combustion, the opposing cool wall portion subjected to cooling air flow, a lip on the downstream end of the louver overlying and spaced from the adjacent downstream louver on the hot wall portion, cooling air holes in a bent portion of the louver upstream of the lip to flow a film of cool air on the inner wall of the louver opposing the lip, dimple means formed in said cool wall portion for limiting the deflection of the lip, said dimple means spaced laterally in the cool air film and extending from the cool wall portion and terminating short of the opposing wall, and apertures formed on the downstream wall of said dimple means for flowing cool air immediately downstream of said dimple means relative to the flow of cool air so that when said opposing wall portion abuts said dimple means liner burning at this point does not ensue.

2. For a louver constructed liner as in claim 1 wherein said apertures are drilled holes.

3. For a louver constructed liner of claim 1 wherein said apertures are integral with said dimple.

* * * * *